US008151773B2

(12) United States Patent
Prior

(10) Patent No.: US 8,151,773 B2
(45) Date of Patent: Apr. 10, 2012

(54) ENGINE WITH BELT/ALTERNATOR/SUPERCHARGER SYSTEM

(75) Inventor: Gregory P. Prior, Birmingham, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 836 days.

(21) Appl. No.: 12/236,536

(22) Filed: Sep. 24, 2008

(65) Prior Publication Data

US 2010/0071673 A1 Mar. 25, 2010

(51) Int. Cl.
*F02B 33/36* (2006.01)
*F02B 39/10* (2006.01)

(52) U.S. Cl. ..... 123/559.3; 123/565; 123/559.1

(58) Field of Classification Search ..... 123/559.3, 123/565
See application file for complete search history.

(56) References Cited

U.S. PATENT DOCUMENTS

| | | | | |
|---|---|---|---|---|
| 5,791,315 | A * | 8/1998 | Riach et al. | 123/564 |
| 2004/0237949 | A1* | 12/2004 | Yasui et al. | 123/559.1 |
| 2007/0149336 | A1* | 6/2007 | Sallstrom | 475/5 |
| 2007/0193563 | A1 | 8/2007 | Beattie | |
| 2007/0220885 | A1* | 9/2007 | Turner et al. | 60/605.2 |
| 2008/0173017 | A1 | 7/2008 | St. James | |
| 2009/0019852 | A1* | 1/2009 | Inoue et al. | 60/608 |
| 2010/0199956 | A1* | 8/2010 | Lofgren | 123/565 |

FOREIGN PATENT DOCUMENTS

| | | |
|---|---|---|
| DE | 10056430 | 11/2000 |
| WO | 00/32917 | 6/2000 |
| WO | 2008/020184 | 2/2008 |

* cited by examiner

*Primary Examiner* — Burton Mullins
(74) *Attorney, Agent, or Firm* — Quinn Law Group, PLLC

(57) ABSTRACT

An internal combustion engine for an automotive vehicle includes a belt, alternator, supercharger (BASC) power system having a positive displacement supercharger with coacting rotors, a belt drive from the engine to the supercharger, an overrunning clutch allowing the supercharger to overrun the belt drive, and a motor-generator connected to charge a battery when the motor-generator is overrunning the belt drive. The system allows electric overrun of the supercharger to increase engine charge air and power at low engine speeds, to electrically offset some parasitic losses and increase power at high engine speeds, to use supercharger inertia to drive the motor-generator and charge the battery during engine decelerations, and to electrically reduce belt drive loads by supplementing supercharger drive power during transmission downshifts that increase engine speed, and thus minimize "chirping" sounds due to belt slipping.

18 Claims, 3 Drawing Sheets

ENGINE WITH BELT/ALTERNATOR/SUPERCHARGER SYSTEM

TECHNICAL FIELD

This invention relates to positive displacement compressors or superchargers, such as Roots type or screw compressors utilized for automotive engine superchargers.

BACKGROUND OF THE INVENTION

It is known in the art to apply electric boosting of vehicle turbochargers using an electric motor to quickly accelerate the turbocharger wheels and reduce boost lag during vehicle acceleration. It is desired to apply this and other concepts to positive displacement machines having coacting rotors, such as Roots rotors or screw rotors, for supercharging internal combustion engines. Such a device used as an automotive supercharger may include a housing having a rotor cavity in which a pair of parallel rotors having interleaved lobes rotate to pump or compress air drawn into one end of the housing and discharged through an opening in the cavity wall near an opposite end of the housing. The rotors may be belt driven by the engine through a pulley connected through a gear train to the pair of rotors.

SUMMARY OF THE INVENTION

The present invention provides an internal combustion engine power system, including an engine, which may be installed in a vehicle. The engine may include a positive displacement supercharger having a housing defining a rotor cavity in which a pair of coacting or interleaved rotors rotate in timed relation to pump air from an inlet to an outlet. A belt drive connects an output of the engine with an input of the supercharger. The belt drive includes an overrunning clutch that allows the supercharger to overrun the belt drive. An electric motor is connected with the supercharger input for driving the supercharger at overrun speeds exceeding the belt drive speed.

The electric motor may be a motor-generator connected to charge a battery and to be driven by the battery for operating the supercharger at overrun speeds. During engine or vehicle deceleration, rotary inertia of the supercharger rotors and the motor-generator may temporarily drive the supercharger and motor at overrun speeds exceeding the belt drive speed and allow the excess inertia to be used for charging the battery.

At low engine speeds, the motor may drive the supercharger at overrun speeds to increase charge air pressure to the engine for increasing engine torque and power. At high engine speeds, the motor may supplement the power of the belt drive, allowing the reduced load on the belt drive to increase engine torque and power.

During transmission downshifts, when engine speed increases, the motor may apply torque to absorb some of the drive belt load spikes and eliminate momentary belt slippage and an associated undesired "chirping" sound.

A drive clutch may be connected between the supercharger and the overrunning clutch for disconnecting the supercharger from the power system when desired.

These and other features and advantages of the invention will be more fully understood from the following description of certain specific embodiments of the invention taken together with the accompanying drawings.

DESCRIPTION OF AN EXEMPLARY EMBODIMENT

Figure 1:
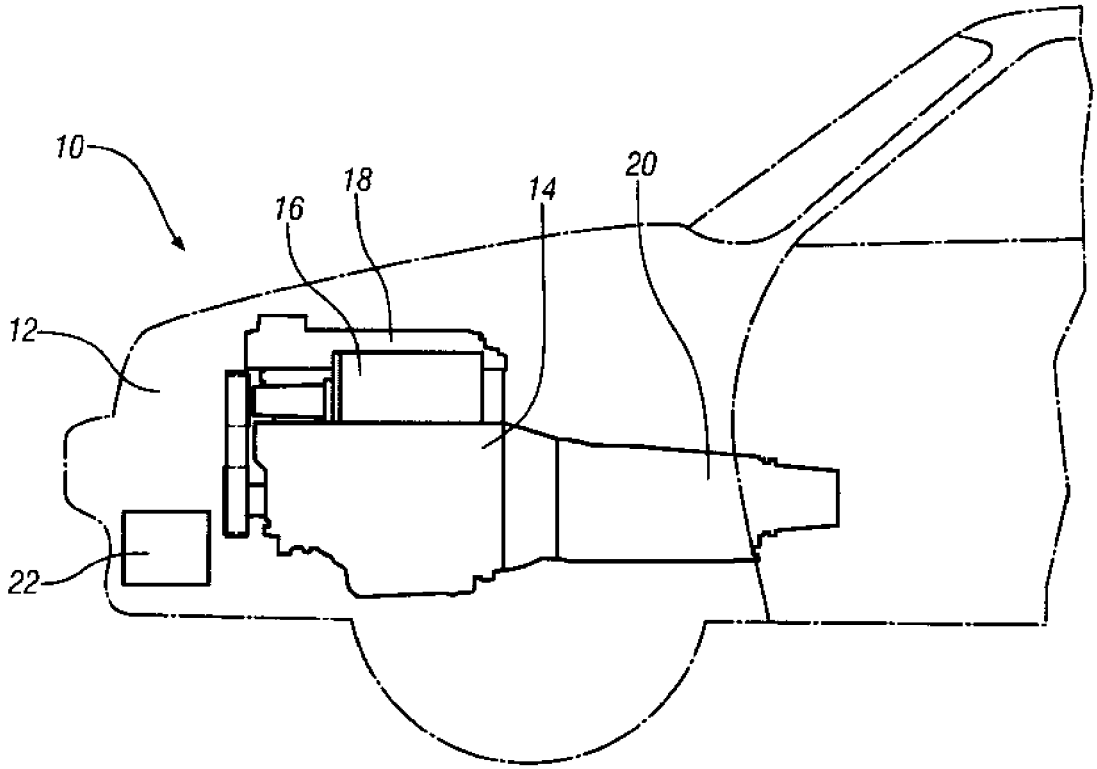
FIG. 1 is a partial pictorial view of an automotive vehicle having an engine mounting a supercharger and connected with other associated components.

Referring first to FIG. 1 of the drawings in detail, numeral 10 generally indicates a portion of an automotive vehicle having an engine compartment 12 containing an internal combustion engine 14. Engine 14 mounts a positive displacement rotary compressor or supercharger 16 according to the invention. The supercharger 16 connects with an engine intake manifold 18 for pumping charge air to the engine cylinders, not shown. The engine is connected with a transmission 20 for conventionally varying the engine speed relative to vehicle speed when shifting through various gear ratios of the transmission. A battery 22 is mounted in the engine compartment 12, or another suitable location, for providing electric power to the engine and vehicle controls.

Figure 2:
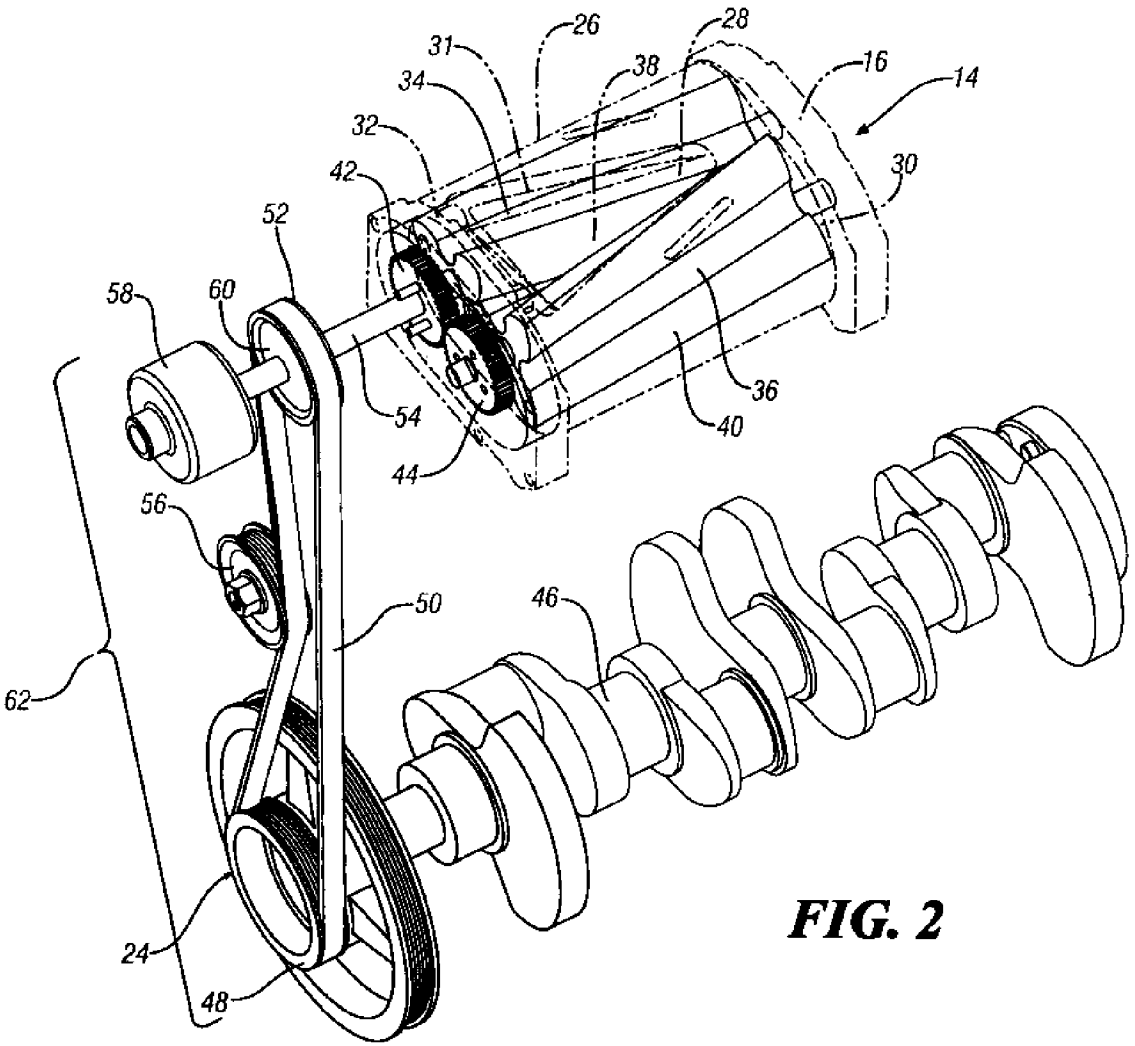
FIG. 2 is a pictorial view of rotatable components of a belt, alternator, supercharger power system of the invention as combined with the vehicle engine of FIG. 1.

FIG. 2 of the drawings illustrates a first embodiment of the invention ca[able of various modes of operation. In order that the operation may be clearly understood, the various components illustrated in FIG. 2 will first be explained.

The figure shows the engine 14 with a belt, alternator, supercharger system 24 according to the invention. The system includes a supercharger 16 illustrated as a Roots blower type, although a screw compressor could be used if desired within the scope of the invention. The supercharger 16 includes a rotor housing 26 having an internal rotor cavity 28. An inlet opening, not shown, communicates an inlet end 30 of the cavity 28 with a source of inlet air, not shown. An outlet opening 31 communicates an outlet end 32 of the cavity 28 with the engine intake manifold 18.

Within the cavity 28 there are rotatably mounted a pair of supercharger rotors 34, 36 having coacting portions 38, 40 for pumping air from the inlet end to the outlet end. The rotors and their lobes, or coacting portions 38, 40, are relatively long and can develop substantial inertia when rotating at high speed in the housing 26. Timing gears 42, 44 maintain a desired relationship of the rotational speeds of the coacting rotors 34, 36.

The rotors may be of the helical Roots type, although a screw type supercharger having air compressing screw type rotors could be used if desired.

Figure 3:
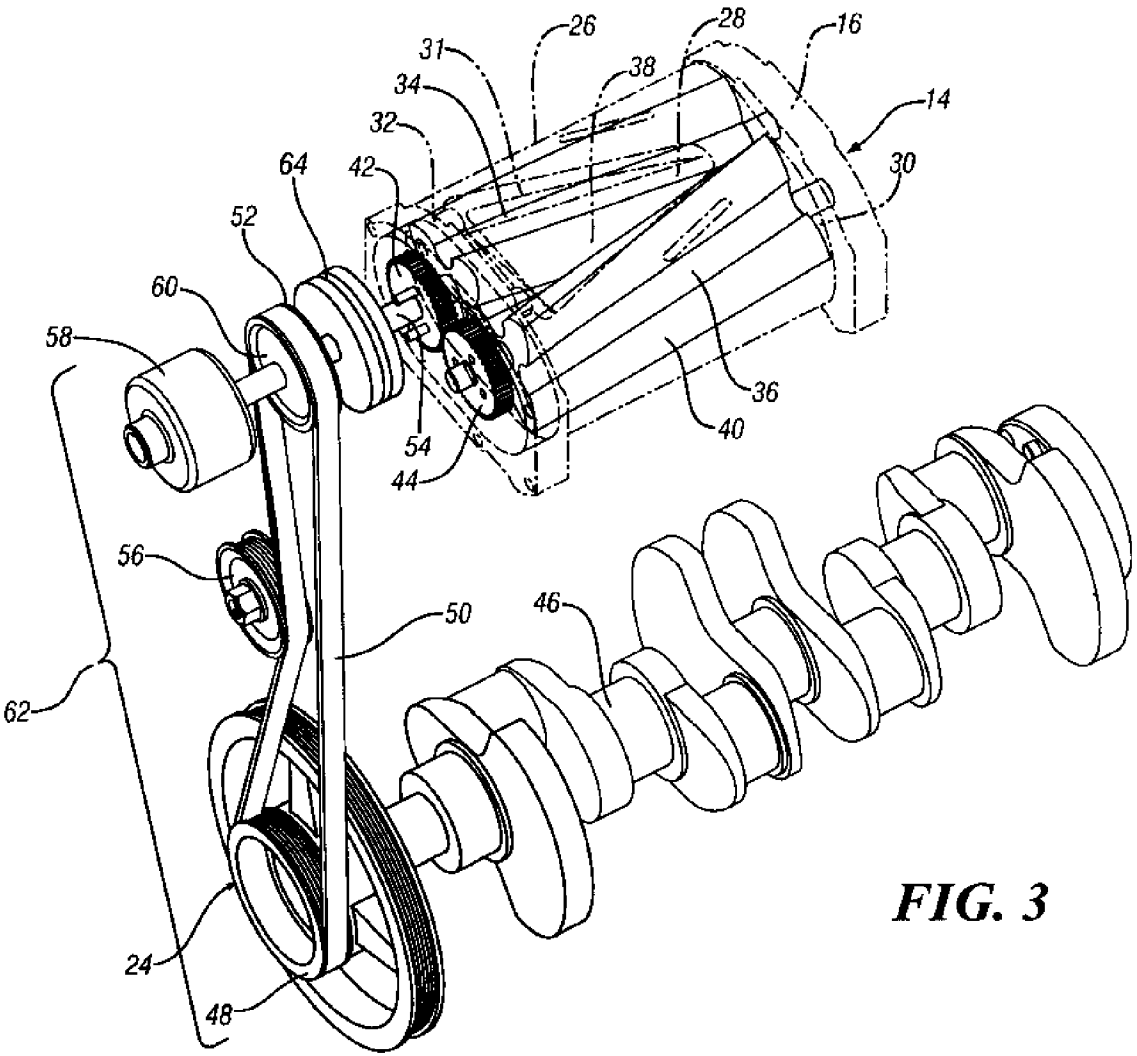
FIG. 3 is a view similar to FIG. 2 but including a supercharger drive clutch in the drive shaft between the supercharger and the belt drive pulley overrunning clutch.

In FIGS. 2 and 3, an engine output is represented by an engine crankshaft 46. The crankshaft mounts a drive pulley 48, which is drivably connected by a drive belt 50 to a driven pulley 52 mounted on a supercharger drive shaft 54 connected with a timing gear 42 of the supercharger 16. A tensioner pulley 56 maintains tension of the belt 50 on the drive and driven pulleys 48, 52. An electric motor-generator 58 is drivably connected at a distal end of the supercharger drive shaft 54. The driven pulley 52 includes an overrunning clutch 60, which is oriented to allow the supercharger 16 and the motor-generator 58 to be driven at an overrun speed greater than the rotational speed of the driven pulley 52 of the belt drive 62.

The belt drive 62 includes the drive pulley 48, drive belt 50, driven pulley 52, tensioner pulley 56 and the overrunning clutch 60 in the driven pulley 52. When the engine is running, the belt drive continuously rotates the supercharger drive shaft 54, which drives the supercharger 16 and the motor-generator 58 at a rotational speed which is a function of the engine speed. However, the motor-generator 58 may be operated to drive the supercharger at an overrun speed, greater than that provided by the belt drive, when the motor power is sufficient. Also, during engine deceleration, the inertia of the supercharger rotors and the motor-generator can be used to drive the motor-generator faster than the belt drive and thus generate electric power to charge the battery, as will be subsequently more fully described.

The embodiment of FIG. 3 includes all the components as described above and, in addition, includes a supercharger drive clutch 64, which splits the drive shaft 58 between the supercharger 16 and the drive pulley 48, carrying the overrunning clutch. This allows disconnecting the supercharger from the BASC drive system 24, if desired, so that the supercharger is not operational.

Referring now to the individual FIGS. 2, 3, the various operating modes and their advantages will now be discussed.

FIG. 2 illustrates the base arrangement of the belt, alternator, supercharger (BASC) system 24 carried in and on the engine 14. The system 24 is also associated with the vehicle battery 22 which is charged by the system and to which it supplies electric power. Downshifting of the vehicle transmission 20 also has an effect on the BASC system 24 as will be subsequently discussed. The supercharger is driven at all times when the engine is running, but is operated in a bypass mode with low parasitic loss when supercharging of the engine charge intake air is not desired.

In cruising, the belt drive 62 drives the supercharger 16 and motor-generator 58 through the crankshaft 46 mounted drive pulley 48, drive belt 50, driven pulley 52 and locked-up overrunning clutch 60 to the supercharger drive shaft 54, to also charge the battery. However, in some conditions, the motor-generator 58 can drive the supercharger 16 at overrun speeds above the belt drive speed, such as at low engine speeds. Also, at high engine speeds, inertia of the supercharger 16 and motor-generator may drive the motor-generator 58 at overrun speeds through the unlocked overrunning clutch 60 to charge the battery 22 during deceleration of the engine 14.

A first operating mode of the BASC system 24 includes low load and cruising operation of the vehicle engine 14. The supercharger 16 and motor-generator 58 are rotated by the belt drive 62 through the locked-up overrunning clutch 60 at a speed determined by the engine speed. The supercharger 16 may be operating in bypass mode to minimize parasitic loss. The motor generator 58 may be charging the battery 22, or running free if the battery is fully charged.

A first alternative operating mode includes low rpm, wide open throttle operation of the engine 14 during rapid vehicle acceleration. The motor-generator 58, powered by the battery 22, drives the supercharger 16 at an overrun speed exceeding the belt drive speed in order to provide maximum boost of the engine intake air pressure. The overrunning clutch 60 is unlocked and the belt drive 62 is free running at a lower engine speed.

A second alternative operating mode includes high rpm, wide open throttle operation of the engine 14. The belt drive 62 is the primary source of power for driving the supercharger 16 at a high speed related to engine speed. Thus, the overrunning clutch 60 is locked up. The motor-generator 58 is incapable of driving the supercharger 16 faster than the belt drive at high speed, but it can reduce the load on the belt drive 62 by adding torque to the drive shaft 54, taking part of the supercharger drive load and reducing the parasitic load on the belt drive 62. The load reduction on the belt drive 62 may allow the belt drive to slightly increase the supercharger speed, thus increasing available charge air flow to the engine 14 and providing for increased engine power during acceleration.

A third alternative mode of operation of the BASC system 24 may occur during engine deceleration. If deceleration is gradual and the inertia of the supercharger 16 is expended by slowing the supercharger 16 as the engine inertia slows the engine 14, then the supercharger 16 will not overrun the belt drive 62 speed and the overrunning clutch 60 will remain locked-up so that the supercharger 16 and the engine 14 decelerate together at related speeds.

However, if the engine 14 deceleration is rapid due, for example, to parasitic engine braking forces, the high inertia of the supercharger rotors 34, 36 and the motor-generator 58 will cause the supercharger rotors and the motor-generator to overrun the belt drive speed, unlocking the overrunning clutch 60. This will allow the motor-generator 58 to generate additional electric current for charging the battery 22 until the overrun speed of the supercharger drops to the belt drive speed. Then, the battery charging will again be powered by the belt drive 62 without further electric regeneration. Thus, the BASC system 24 allows the inertia of the supercharger 16 and motor-generator 58 to provide additional battery charging each time the throttle is closed rapidly and the supercharger speed overruns the belt drive speed.

A fourth alternative mode of operation of the BASC system 24 may be initiated during downshifts of the vehicle transmission 20, which cause momentary rapid increases of the engine speed. The rapid speed increases result in high loads on the belt drive 62, which tries to accelerate the supercharger 16 and motor-generator 58 at the same percent rate increase as the engine speed increase. The result may be that the drive belt 50 slips slightly on the pulley 48 or 52, causing a squeak or "chirp" that is perceptible to a vehicle driver. This is overcome by applying torque with the motor-generator to reduce the load increase, or spike, on the belt drive 62 whenever a load spike occurs and thereby avoid belt slippage and the undesirable "chirping" noise.

FIG. 3 illustrates an alternative embodiment of the invention in which a drive clutch 64 is provided in the drive shaft 54 between the supercharger 16 and the driven pulley 52. The drive clutch 64 allows the supercharger to be disconnected from the belt drive 62 whenever desired by the operator. This has the benefit of removing the parasitic load of the bypassed supercharger 16 from the load on the drive belt 62, whenever supercharging is not needed.

In addition, many current supercharger drive clutches have load limits that prevent engaging the supercharger unless the engine speed is fairly low due to rotor inertia and rotor compression. This interferes with the desired use of a supercharger on demand and thus introduces an operational limitation resulting at times in undesirable parasitic losses during low load high speed cruising. By using the motor-generator to assist during engagement of the supercharger clutch 64, a higher speed engagement would be possible, resulting in lower high speed cruising losses and improving fuel economy.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. An internal combustion engine power system comprising:

an internal combustion engine;

a positive displacement supercharger mounted to the engine for providing pressurized charge air to the engine;

a belt drive connecting an output of the engine with an input of the supercharger for driving the supercharger, the belt drive including an overrunning clutch allowing the supercharger to overrun the belt drive; and an electric motor connected with the supercharger input and configured to alternately reduce the belt drive load by adding torque to the input and drive the supercharger at overrun speeds exceeding the belt drive speed.

2. A system as in claim 1, wherein the electric motor is a motor-generator configured to alternately charge a battery and to be driven by the battery for operating the supercharger at overrun speeds.

3. A system as in claim 2, wherein rotary inertia of the supercharger and associated components is sufficient to overrun the belt drive when the engine speed is decreased, thereby allowing use of excess inertia for charging the battery.

4. A system as in claim 2, wherein the motor is configured to drive the supercharger at overrun speeds to increase charge air pressure to the engine for increasing engine power when the engine speed is low.

5. A system as in claim 2, wherein the belt drive includes a belt connecting a drive pulley mounted on the engine output and a driven pulley mounted on the supercharger input.

6. A system as in claim 2, wherein the engine output is an engine crankshaft and the supercharger input is a supercharger drive shaft.

7. A system as in claim 2, further comprising a drive clutch arranged between the supercharger input and the overrunning clutch and configured to disconnect the supercharger from the power system when desired.

8. A belt, alternator, supercharger power system for an internal combustion vehicle engine, the system comprising:

a positive displacement supercharger mounted to the engine for providing pressurized charge air to the engine;

a belt drive connecting an output of the engine with an input of the supercharger for driving the supercharger; and an electric motor connected with the supercharger input and configured to reduce the belt drive load by adding torque to the input.

9. A system as in claim 8, wherein the supercharger includes:

a housing defining a rotor chamber enclosing a pair of coacting rotors connected for timed rotation therein.

10. A system as in claim 9, wherein the belt drive includes an overrunning clutch allowing the supercharger to overrun the belt drive and a belt connecting a drive pulley mounted on the engine output and a driven pulley mounted on the supercharger input.

11. A system as in claim 10, wherein the electric motor is a motor-generator additionally configured to alternately charge a battery and be driven by the battery for operating the supercharger at overrun speeds exceeding the belt drive speed.

12. A system as in claim 11, wherein rotary inertia of the supercharger and associated components is sufficient to overrun the belt drive when the engine speed is decreased, thereby allowing use of excess inertia for charging the battery.

13. A system as in claim 12, further comprising a drive clutch arranged between the supercharger input and the overrunning clutch and configured to disconnect the supercharger from the power system when desired.

14. A method of operating an internal combustion engine for use in a vehicle, the engine including a belt, alternator, supercharger system having a belt drive between the engine and the supercharger, a motor generator drive for independently driving the supercharger with battery power, an overrunning clutch allowing the motor to drive the supercharger at speeds exceeding belt speed, and inertia of the supercharger and associated components to drive the motor generator at low engine speeds or during supercharger deceleration, the method comprising at least one of the following two operating modes:

(1) at low engine speeds, driving the supercharger with the motor generator to increase charge air pressure for increased engine torque; and (2) at high engine speeds, supplementing the belt drive with power from the motor generator, thereby offsetting parasitic losses of the supercharger and increasing the resultant engine torque;

and at least one of the following two operating modes:

(3) during deceleration of the vehicle with engine power reduced, driving the motor generator with the inertia of the overrunning supercharger rotors and the motor generator itself to temporarily provide electric energy to charge the battery; and (4) during transmission gear downshifts of the vehicle causing increased engine speed, applying momentary motor generator power to assist supercharger acceleration and reduce slipping of the belt drive to eliminate undesired "chirping" sounds.

15. The method of claim 14, wherein the method consists of mode (1).

16. The method of claim 14, wherein the method consists of mode (2).

17. The method of claim 14, wherein the method consists of mode (3).

18. The method of claim 14, wherein the method consists of mode (4).

* * * * *